United States Patent [19]

Wilson

[11] Patent Number: 4,515,567

[45] Date of Patent: May 7, 1985

[54] TROLLING MOTOR FOOT CONTROL

[76] Inventor: Jay R. Wilson, P.O. Box 506, Dewey, Okla. 74029

[21] Appl. No.: 539,118

[22] Filed: Oct. 5, 1983

[51] Int. Cl.[3] ..... B63H 25/00

[52] U.S. Cl. ..... 440/7; 74/512; 114/153

[58] Field of Search ..... 74/478, 478.5, 512; 440/7; 114/153

[56] References Cited

U.S. PATENT DOCUMENTS

| | | | |
|---|---|---|---|
| 2,912,877 | 11/1959 | Rohrer | 114/153 X |
| 2,968,273 | 1/1961 | Corbett et al. | 114/153 |
| 4,386,918 | 6/1983 | Matthews et al. | 114/153 |

*Primary Examiner*—Sherman D. Basinger

*Attorney, Agent, or Firm*—Head, Johnson & Stevenson

[57] ABSTRACT

This invention consists of a foot operated trolling motor control assembly that may be either temporarily clamped to, or permanently mounted upon either the fore or aft located boat transom. Rotational steering of the trolling motor is accomplished through the action of a foot operated pedal pivotally driving the lower end of a vertical lever by an interconnecting, horizontal shaft; a spring loaded connecting rod both vertically and horizontally pivoted to the upper end of the vertical lever; and a split collar and horizontal lever assembly clamped upon a vertical, rotatable, trolling motor shaft with the collar's horizontal lever portion attached to the spring loaded connecting rod through both horizontal and vertical pivots at the rod end opposite the vertical lever mounting. Split bushings may be used within the bore of the split collar assembly in order to accommodate various trolling motor shaft diameters. An auxiliary trolling motor electrical control system is also provided which incorporates a two conductor battery cable, two trolling motor terminals, a foot pedal mounted momentary contact electrical switch, and necessary wiring to provide for the activating of the electrical trolling motor by conveniently pressing the momentary contact switch with the foot when so desired.

3 Claims, 9 Drawing Figures

TROLLING MOTOR FOOT CONTROL

BACKGROUND OF THE INVENTION

1. Field of the Invention

This invention relates to improvements in steering control devices and more particularly, but not by way of limitation, to a foot actuated control means for both the steering and actuation of a trolling motor, or the like, used on relatively small boats.

2. Description of the Prior Art

Users of small one, two or three man plastic, fiberglass, or metal mini-boats typically use a hand operated, vertical shaft, battery operated, electric trolling motor for propelling their boat. This trolling motor is usually clamped upon either the front or rear transom of the boat and is manually steered by hand. Activation of the electrical portion of the trolling motor is usually accomplished by the use of a hand operated switch affixed to the upper portion of the trolling motor assembly.

Many times it is desirable for the boat operator to have their hands free to uses other than control of the trolling motor, particularly when one is fishing, and in either windy or running water conditions. It is further desirable that any control device for leaving the hands free would be light in weight and also be simple and basic in construction since the boats are generally small and light weight themselves.

Although foot controlled trolling motors are available for larger boats, their size and complexity preclude their use on smaller boats and a definite need exists for a light weight and uncomplicated foot control for use with simple hand operated trolling motors on small boats.

The primary object of this invention is to provide such a simple and light weight control which allows the existing trolling motor to be both steered and electrically actuated by foot action alone, thereby leaving both of the boat operator's hands free for other purposes.

SUMMARY OF THE INVENTION

The invention comprises a foot operated trolling motor control assembly that may be either temporarily clamped to, or permanently mounted upon, either the fore or aft located boat transom. Rotational steering of the trolling motor is accomplished through the action of a foot operated pedal pivotally driving the lower end of a vertical lever by means of an interconnecting, horizontally mounted, pivotal shaft; a spring loaded, horizontal, connecting rod both vertically and horizontally pivoted to the upper end of the vertical lever; and split collar and horizontal lever assembly clamped upon a vertical, rotatable, trolling motor shaft with the horizontal lever portion attached to the spring loaded connecting rod through both horizontal and vertical pivots at the rod end opposite the spring and vertical lever mounting. Split bushings may be used within the bore of the split collar and horizontal lever assembly in order to accommodate various trolling motor shaft diameters. A trolling motor electrical control system is also provided which incorporates a two conductor battery cable, two trolling motor terminals, a foot pedal mounted momentary contact electrical switch, and necessary wiring to provide a means of activating the electrical trolling motor by means of conveniently pressing the momentary contact switch with the foot when so desired.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF A PRESENTLY PREFERRED EMBODIMENT OF THE INVENTION

Figure 1:
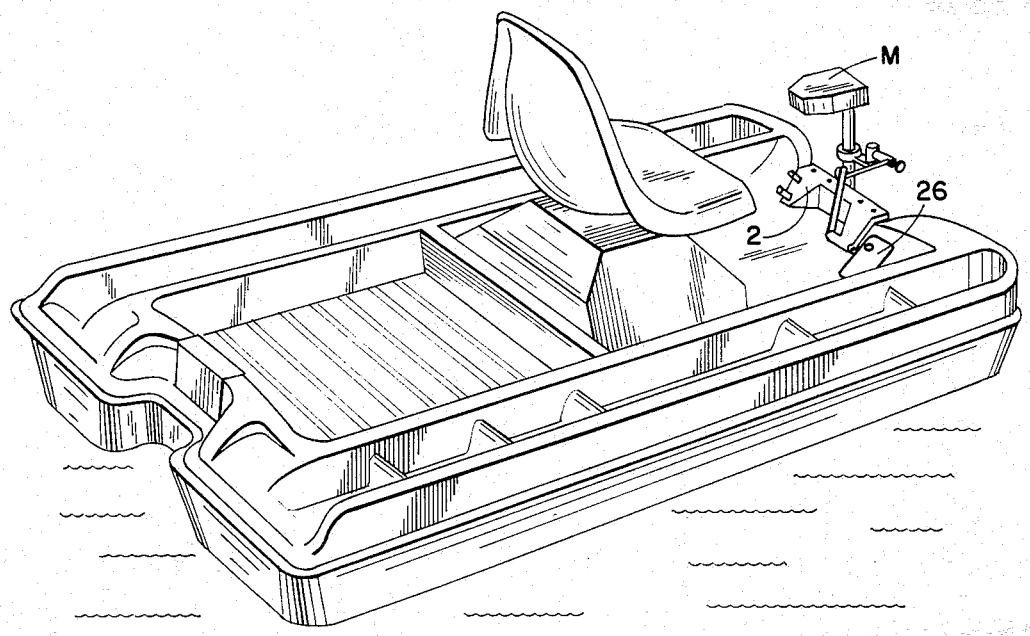
FIG. 1 is a pictorial view of the invention mounted upon the front transom of a small boat equipped with an electrical trolling motor.
Figure 2:
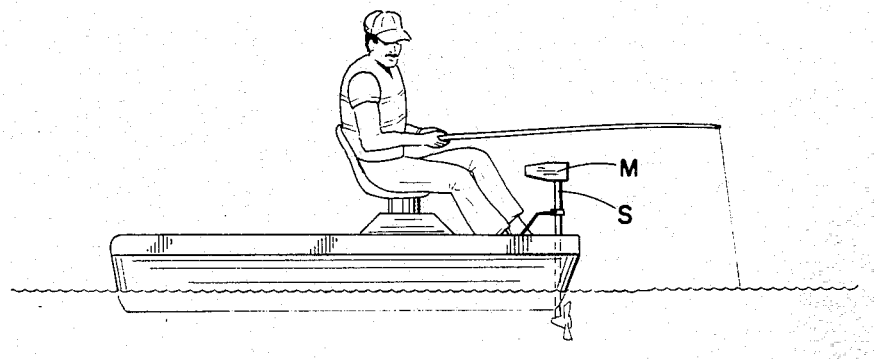
FIG. 2 is a pictorial view of the invention being controlled by the foot of a typical fisherman.
Figure 3:
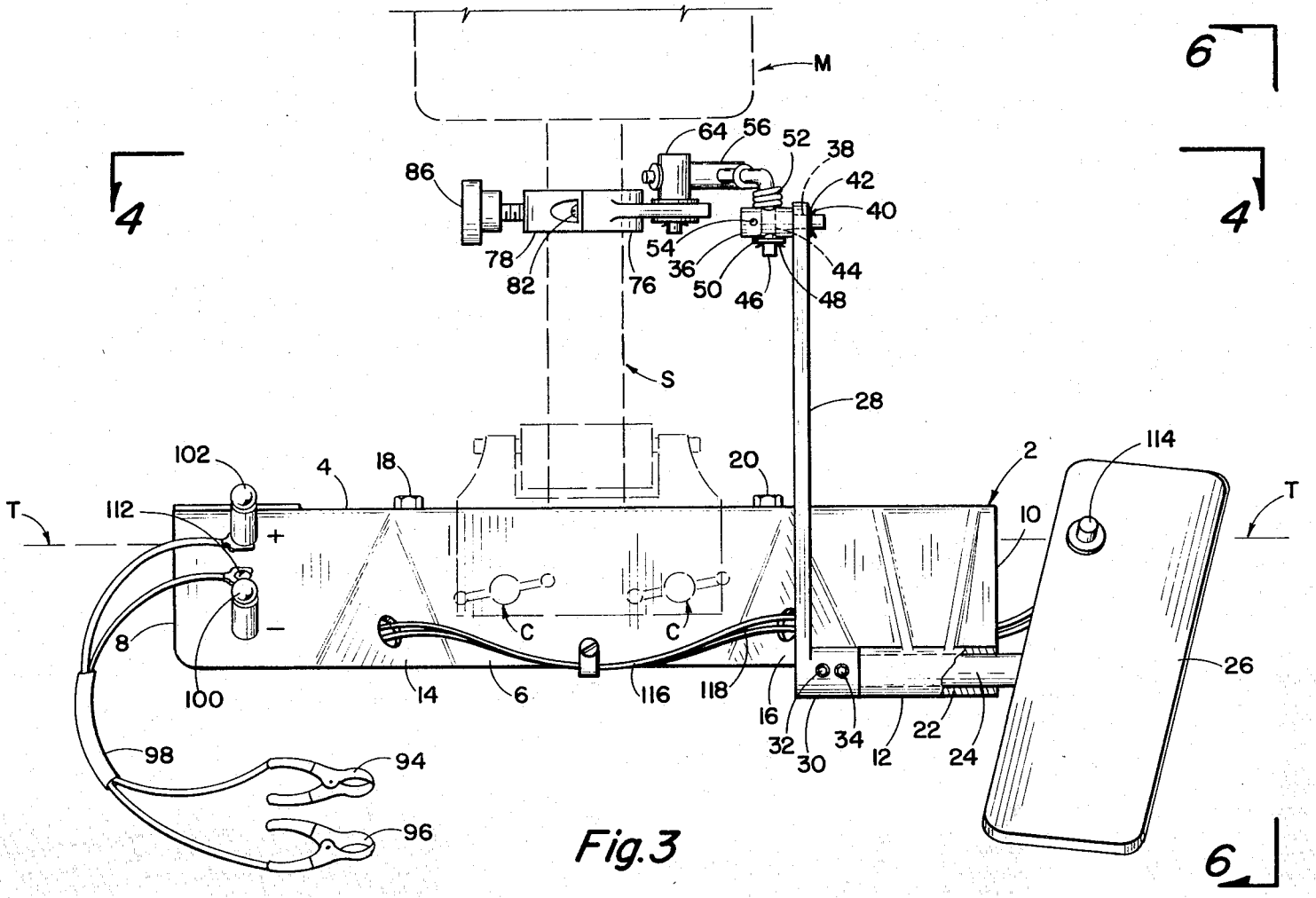
FIG. 3 is an elevational view of the invention as seen from inside the boat with the trolling motor shown in straight ahead position.
Figure 4:
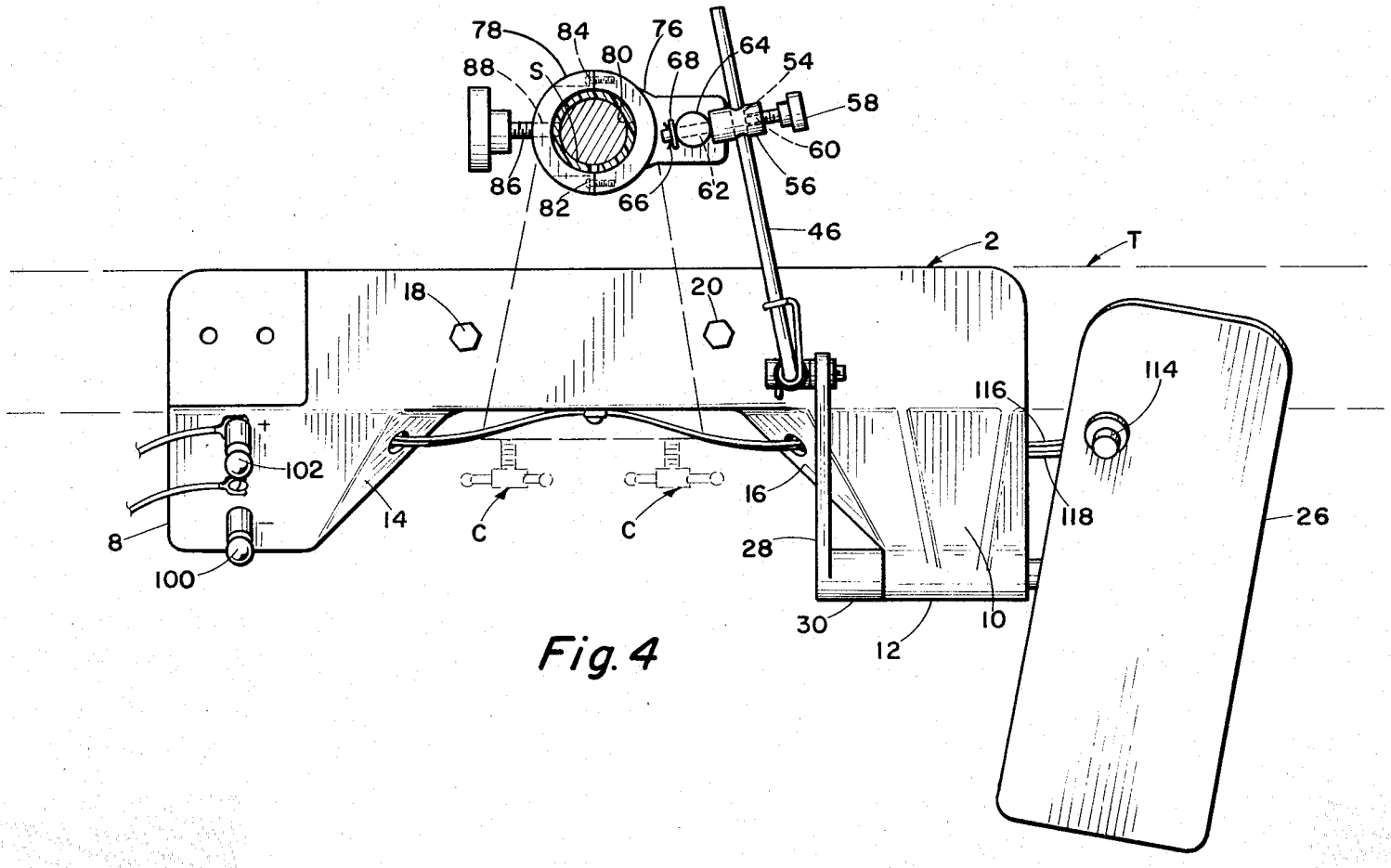
FIG. 4 is a plan view of the invention as seen from the aspect of line 4—4 of FIG. 3 with the trolling motor shown in straight ahead position.

Referring in detail to the drawings, wherein like numerals designate like parts throughout the several views, the illustrated foot control includes an elongated frame member 2 of generally integrated construction consisting of a horizontally overhung top plate 4, a depending face plate 6, and angularly extended mounting plate 8, an angularly extended support plate 10, a cylindrical shaft support 12, and two load bearing gussets 14 and 16 as shown in FIGS. 3 and 4. Frame 2 may be temporarily attached to an existing boat transom T by use of the screw clamps C and C of a typical hand operated trolling motor assembly M with top plate 4 resting upon the uppermost surface of transom T as shown in FIG. 3. As an alternative, frame 2 may also be permanently mounted upon a boat transom T by means of screws 18 and 20 extending through their respective holes in frame 2 with both screws engaging transom T. Integral with frame 2 and located generally toward the lower right portion of said frame as viewed in FIG. 3 exists a shaft support 12 cylindrical bore 22, whose axis parallels the longitudinal axis of frame 2.

A freely rotatable, cylindrical, pivotal shaft 24 is provided which is integral with pedal 26 and which extends through shaft support 12 and interconnects foot pedal 26 with the lower end of vertical lever 28 and its integral collar 30. Vertical lever 28 and cylindrical collar 30 are both attached to shaft 24 by means of threaded set screws 32 and 34 extending through collar 30 and pressing upon shaft 24.

Shouldered pivot 36 is free to rotate about its horizontal, longitudinal, axis with its minor diameter portion extending through hole 38 which is located near the upper end of vertical lever 28. Pivot 36 is loosely retained in hole 38 by cotter pin 40 and washer 42. The pivot 36 also incorporates a hole 44 through its major diameter, with said hole's axis being perpendicular to the longitudinal axis of the pivot. Hole 44 retains the vertical portion of connecting rod 46 by means of cotter pin 48 and washer 50 while allowing freedom of rotational motion around the vertical axis portion of connecting rod 46. An effective freedom of motion is thus established whereby connecting rod 46 may be pivoted both horizontally and vertically with respect to vertical lever 28 by means of shouldered pivot 36.

One end of torsional spring 52 extends into, and is retained by, a hole 54 existing through the major diameter portion of shouldered pivot 36; the hole's axis being perpendicular to said pivot's longitudinal axis. Hole 54 is radially located approximately ninety degrees to, but axially offset from, hole 44. The opposite end of torsional spring 52 extends essentially parallel with, and adjacent to, the horizontal and longitudinal axis of connecting rod 46 with the extreme spring end then curving around, but loosely attached to, the connecting rod 46. The coiled portion of torsional spring 52 is freely wound around the vertical portion of connecting rod 46 so as to produce a spring loaded, clockwise, rotational thrust upon the connecting rod when viewed from above as in FIG. 4.

As shown in FIG. 4, the horizontal portion of connecting rod 46 extends freely through a hole 54 in shouldered pivot 56; the hole's axis being perpendicular to the longitudinal axis of said pivot with the location of hole 54 being approximately midway along the length of the major diameter portion of pivot 56. Thumbscrew 58, whose thread axis 60 coincides with the longitudinal axis of shouldered pivot 56, is used to clamp the horizontal portion of connecting rod 46 to pivot 56, but which also allows freedom of removal or of adjustment in the engagement length between connecting rod 46 and shouldered pivot 56. The minor diameter portion of shouldered pivot 56 extends through a cross-hole 62 located approximately midway along the major diameter portion of shouldered pivot 64; pivot 56 being retained by cotter pin 66 and washer 68 so as to allow freedom of rotation about the horizontal, longitudinal, axis of pivot 56.

Figure 6:
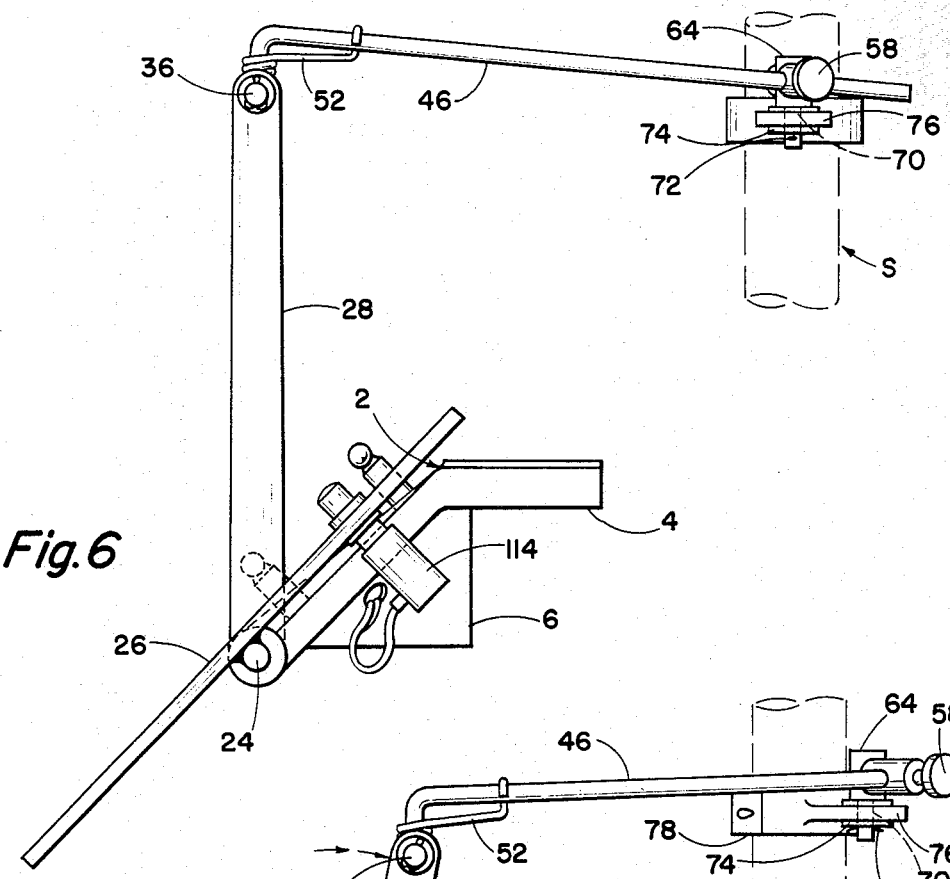
FIG. 6 is an end elevation view of the invention as seen from the aspect of line 6—6 of FIG. 3 with the trolling motor shown in straight ahead position.
Figure 7:
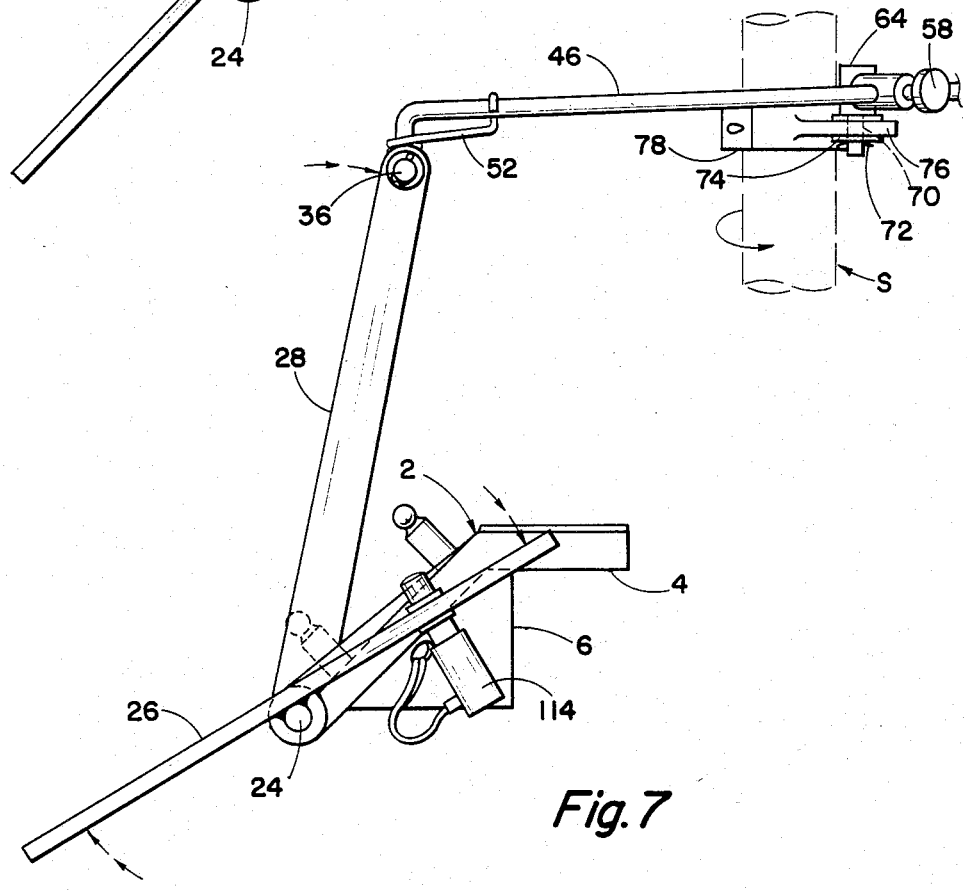
FIG. 7 is an end elevation view of the invention as seen from the aspect of line 6—6 of FIG. 3 with the trolling motor shown in the left turn position.

As shown in FIGS. 6 and 7, the minor diameter portion of shouldered pivot 64 extends vertically through a hole 70 in the lever arm portion of collar segment 76 so as to allow freedom of rotation about the pivot's vertical, longitudinal, axis; pivot 64 being retained by cotter pin 72 and washer 74. A combination now exists at each end of connecting rod 46 whereby both free vertical and free horizontal pivotal motion may exist.

Segments 76 and 78 constitute a collar assembly which is generally cylindrical in nature, with a lever arm integral with one of the collar's two mating segments 76. As shown in FIG. 4, collar assembly 76 and 78 is furnished with a bore 80 which is sufficient in size to be installed upon trolling motor shaft S by means of machine screws 82 and 84 securing the two mating segments of collar assembly 76 and 78 together, but with the condition existing whereby the collar assembly remains free to rotate upon trolling motor shaft S until adjustment knob screw 86 is tightened against said shaft thus binding collar assembly 76 and 78 to shaft S.

Figure 5:
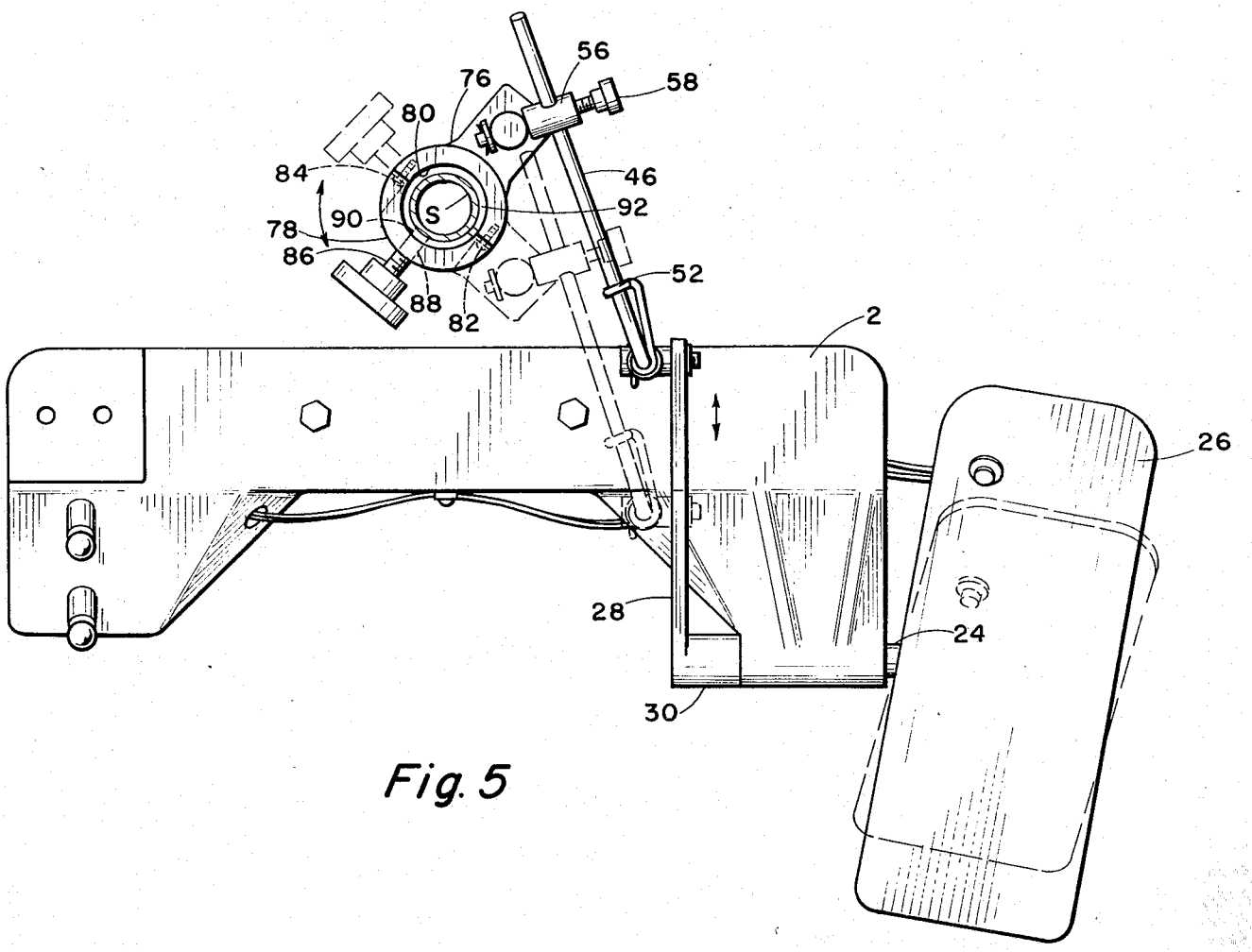
FIG. 5 is a plan view of the invention as seen from the aspect of line 4—4 of FIG. 3 with the trolling motor shown in left turn position and alternately showing the trolling motor in right turn position.

As shown in FIG. 5 adjustment knob screw 86 extends through its mating threaded hole 88, and into bore 80. The axis of threaded hole 88 is located approximately midway both axially and radially in semicircular collar segment 78 and is perpendicular with the axis of bore 80. Screw 86 has sufficient thread extension to extend through hole 90 and bear against trolling motor shaft S in the event cylindrical split bushing 92 is axially inserted into bore 80 for the purpose of accommodating a trolling motor shaft S of smaller diameter than that of bore 80.

Collar segment 76 is furnished with an integral lever arm which is located approximately midway both axially and radially upon the semicircular portion of collar segment 76 with the lever extending laterally outward and on a horizontal plane perpendicular to the vertical axis of bore 80.

Figure 9:
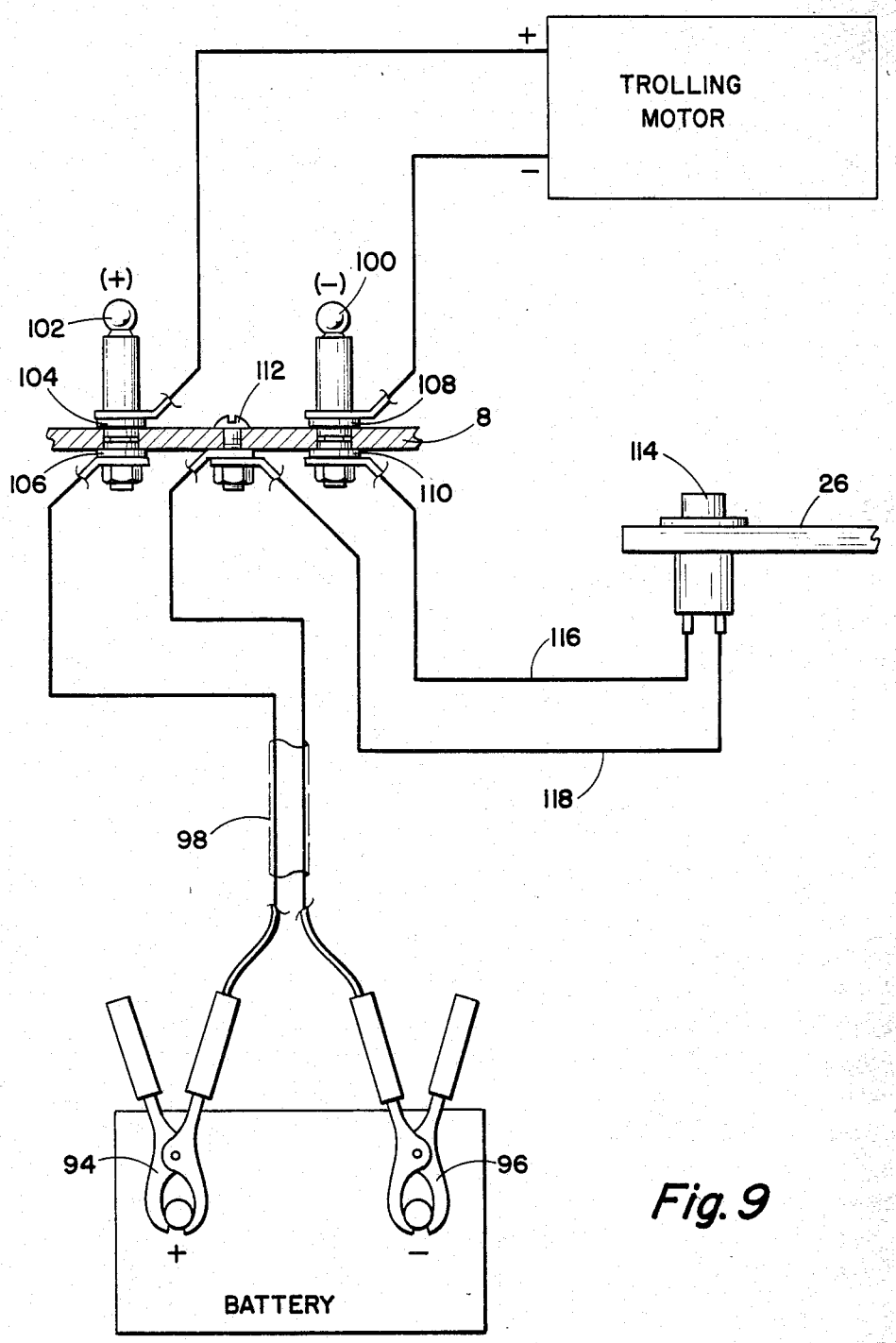
FIG. 9 is an electrical schematic illustrating the general circuitry of this invention.

The electrical system of this invention includes battery clamps 94 and 96 attached to the outermost ends of each of the two insulated conductors comprising power cable 98; two electrically conductive terminals 100 and 102 both of which are electrically insulated from frame member 2 by non-conductive washers 104, 106, 108, and 110; an electrically conductive grounding screw 112; a normally open, momentary contact, push button switch 114; and insulated connecting wires 116, and 118. As shown in the electrical schematic FIG. 9, the circuit from a conventional storage battery attached to cable clamp 94 is continuous to terminal 102, but the circuit from cable clamp 96 is normally open to terminal 100 until the circuit is closed by the activation of momentary contact switch 114.

In use and operation, frame 2 is clamped upon boat transom T by utilizing trolling motor clamps C and C as shown in FIG. 3. Collar segments 76 and 78 are installed upon trolling motor shaft S by use of screws 82 and 84, and with said collar segments located in the approximate position as that shown in FIG. 4, adjustment knob screw 86 is tightened against shaft S. The horizontal portion of connecting rod 46 is then inserted through hole 54 for a distance which provides the most comfortable operating angle of foot pedal 26, and thumbscrew 58 is tightened to secure this setting. Battery clamps 94 and 96 are then attached to the posts of a conventional storage battery and existing trolling motor battery clamps are attached to terminals 100 and 102 with proper polarity being observed. Since a continuous circuit exists between battery clamp 94 and terminal 102, electrical activation of trolling motor M may now be accomplished by merely pressing switch 114 with the foot, thereby closing the open circuit between battery clamp 96 and terminal 100.

To effect steering of trolling motor shaft S the operator now presses his foot upon either the upper or lower portion of pedal 26, thereby causing the upper end of vertical lever 28 to swing either forward or rearward due to the interconnection of pedal 26 and its attached pivot shaft 24 with vertical lever 28 and its integral collar 30. As vertical lever 28 swings either forward or rearward, longitudinal thrust is applied to connecting rod 46 through connecting pivot 36 and said longitudinal thrust is transferred as either clockwise or counterclockwise rotational torque to the lever arm portion of collar segment 76 and attached collar segment 78, which are clamped as an assembly to trolling motor shaft S as shown in FIG. 5. An equal degree of both right and left hand rotational steering of shaft S may be obtained by the loosening of adjustment knob screw 86 and rotationally positioning collar segments 76 and 78 to the preferred location upon shaft S, and then re-tightening screw 86.

Since vertical lever 28 swings in an arc about the axis of pivot shaft 24, and since the lever arm portion of segment 76 swings in an arc about the axis of trolling motor shaft S, each end of connecting rod 46 must be free to pivot or swivel in both horizontal and vertical planes. Shouldered pivot 36 allows such freedom of motion between connecting rod 46 and vertical lever 28, and shouldered pivots 56 and 64 allow such freedom of motion between connecting rod 46 and the lever arm portion of the collar segment 76.

The purpose of torsional spring 52 is to apply a side force against connecting rod 46; said force being perpendicular to, and laterally away from, the vertical axis of trolling motor shaft S, with such force being applied against shouldered pivot 64 by means of its interconnection with connecting rod 46 through pivot 56. Said force, applied against pivot 64 in such described direction, is to assist the return of trolling motor shaft S to its straight ahead position upon completion of either right or left hand steering maneuvers.

Figure 8:
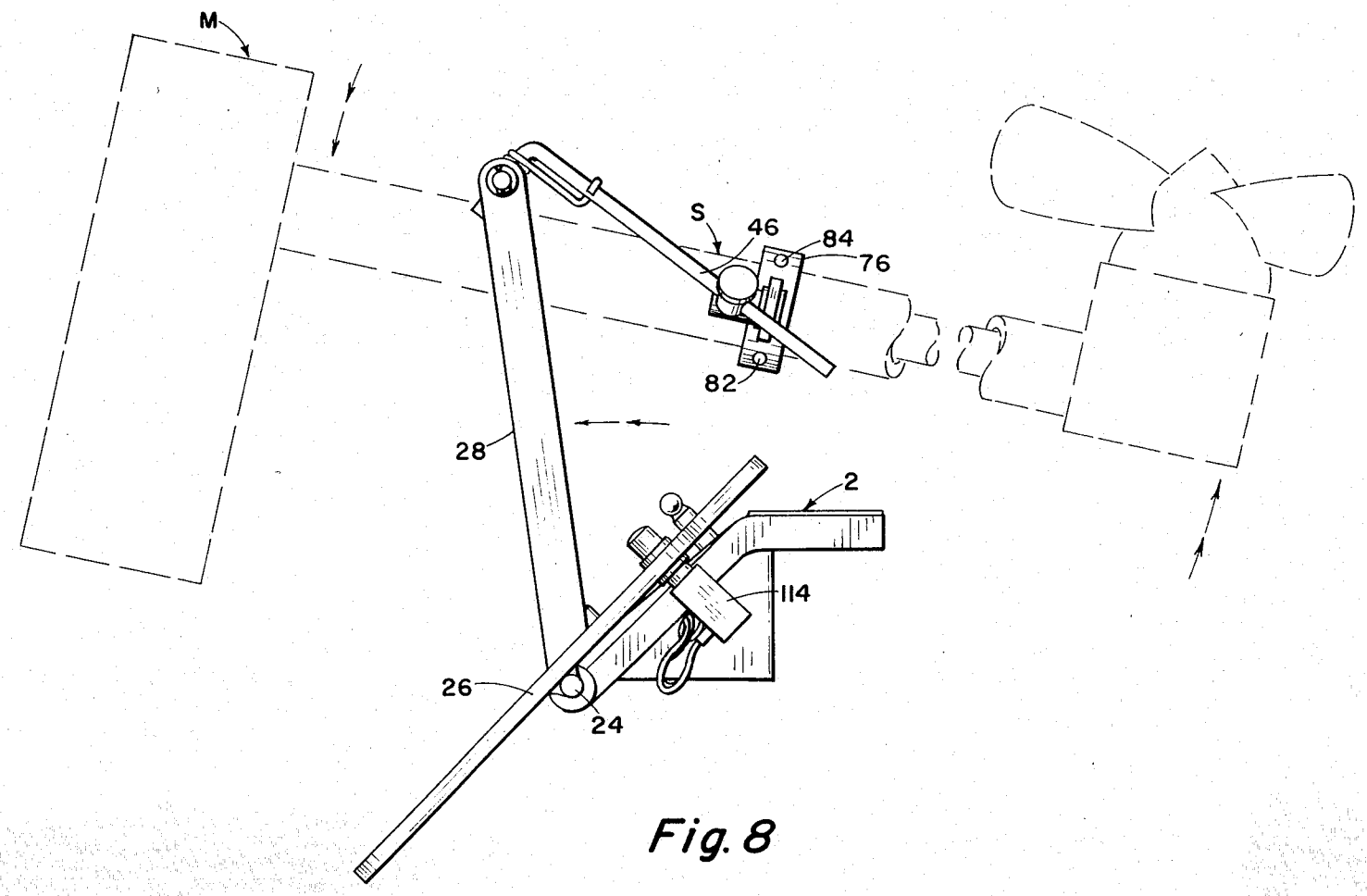
FIG. 8 is an end elevation view of the invention as seen from the aspect of line 6—6 of FIG. 3 with the trolling motor shown pivoted upward out of the water and the controlling linkage automatically retracted. The existing trolling motor pivot is not shown for purposes of clarity.

During operation of this invention, it is occasionally desirable to tilt the trolling motor assembly from the water in order to clear underwater obstructions. As shown in FIG. 8, such tilting can be easily accomplished without binding or other interference from the previously described steering mechanism since there exists freedom of motion in both horizontal and vertical planes at each end of connecting rod 46, and since vertical lever 28 and foot pedal 26 are free to pivot rearward upon pivotal shaft 24. The existing trolling pivot motor is not shown in FIG. 8 for purposes of clarity.

Although there has been shown and described herein a preferred form of the invention, it is to be understood that the invention is not necessarily confined thereto, and that any change or changes in the structure of and in the relative arrangements of components thereof are contemplated as being within the scope of the invention as defined by the claims appended hereto.

What is claimed is:

1. Steering and operating control means for a water craft provided with a trolling motor having a rotatable support shaft, the control means comprising frame means secured to the water craft, foot pedal means pivotally secured to the frame means, linkage means operably connected between the foot pedal means and the support shaft whereby pivoting of the foot pedal means in one direction rotates the support shaft in one direction for turning of the trolling motor in one direction and pivoting of the pedal means in another direction rotates the support shaft in another direction for turning of the trolling motor in another direction to effect the steering of the water craft, power means operably connected between the foot pedal means and the trolling motor whereby activation of the trolling motor may be selectively controlled by the foot pedal means, the power means comprising electrical terminal means operably connected with a power source, switch means secured to the foot pedal means and electrically connected with the electrical terminal means whereby depression of the switch means activates the trolling motor and release of the switch means deactivates the trolling motor, and wherein the linkage means comprises first substantially horizontally disposed pivotal shaft means secured to the foot pedal means, substantially vertically disposed arm means having one end pivotally secured to the first pivot shaft means for angular orientation thereof upon pivoting of the foot pedal means, second substantially horizontally disposed pivot shaft means operably secured at the opposite end of the arm means and between the arm means and the support shaft whereby angular orientation of the arm means in one direction rotates the support shaft in one direction and angular orientation of the arm means in another direction rotates the support shaft in another direction, and yieldable means secured between the second pivot shaft means and the arm means for substantially continuously urging the arm means toward a normal neutral position therefor to provide a normal forward movement of the water craft, the rotation of the support shaft in said one direction moving the trolling motor for causing a left hand direction of movement for the water craft and the rotation of the support shaft in said another direction moving the trolling motor to cause a right hand direction of movement for the water craft.

2. Steering and operating control means as set forth in claim 1 and including means for removably securing the frame means to the water craft.

3. Steering and operating control means as set forth in claim 1 and including means for permanently securing the frame means to the water craft.

* * * * *